United States Patent [19]

Knapp

[11] 4,058,945

[45] Nov. 22, 1977

[54] PRESSURE AND BUCKLING RESISTING UNDULATED POLYHEDRAL SHELL STRUCTURE

[76] Inventor: Ronald H. Knapp, 1629 Hoopai Place, Pearl City, Hawaii 96782

[21] Appl. No.: 458,037

[22] Filed: Apr. 4, 1974

[51] Int. Cl.[2] ..... E04B 1/32

[52] U.S. Cl. ..... 52/244; 52/81; 61/69 R; 61/102; 114/16 R

[58] Field of Search ..... 52/81, 82, 168, 171, 52/202, 224, 244, 245, 246, 248, 249, 515, 517, 80; 61/69 R; 114/77 R, 77 A, 81, 83, 75 R, 16 R; 244/120, 125, 126; 220/1 B

[56] References Cited

U.S. PATENT DOCUMENTS

| | | | |
|---|---|---|---|
| 1,345,985 | 7/1920 | Berkshire | 52/248 |
| 2,203,174 | 6/1940 | Muttray | 52/171 |
| 2,557,990 | 6/1951 | Moyer | 52/81 |
| 2,575,757 | 11/1951 | Hardy | 52/202 |
| 2,659,462 | 11/1953 | Schwartz | 52/80 |
| 3,105,969 | 10/1963 | Banche | 52/81 |
| 3,153,303 | 10/1964 | Wheeler | 52/224 |
| 3,154,821 | 11/1964 | Weker | 52/168 |
| 3,295,265 | 1/1967 | Hida | 52/246 |
| 3,343,324 | 9/1967 | Gordon | 61/69 R |
| 3,354,591 | 11/1967 | Fuller | 52/81 |
| 3,439,460 | 4/1969 | Allen | 52/81 |
| 3,466,880 | 9/1969 | Elliott | 61/69 R |
| 3,477,234 | 11/1969 | Aquino | 61/69 R |
| 3,514,909 | 6/1970 | Nevarez | 52/246 |
| 3,524,288 | 8/1970 | Coppa | 52/81 |
| 3,557,501 | 1/1969 | Kolozsvary | 52/81 |
| 3,661,506 | 5/1972 | Watkins | 52/517 |
| 3,668,876 | 6/1972 | Koehler | 52/80 |
| 3,686,811 | 8/1972 | Hayes | 52/249 |
| 3,729,876 | 5/1973 | Kolozsvary | 52/81 |

FOREIGN PATENT DOCUMENTS

| | | | |
|---|---|---|---|
| 699,912 | 12/1940 | Germany | 52/171 |
| 553,209 | 12/1956 | Italy | 52/82 |

*Primary Examiner*—Price C. Faw, Jr.
*Assistant Examiner*—Henry Raduazo
*Attorney, Agent, or Firm*—Cushman, Darby & Cushman

[57] ABSTRACT

A structure is disclosed for resisting pressure, such as external and internal hydrostatic pressure loading. A plurality of flat polyhedral plates are sealed together along their edges to provide an undulated cylindrical shell. An inner cylinder (and end enclosures for transferring axial loading from the outer shell to the inner cylinder) provides axial restraint. A dome over the inner cylinder may form a part of the end structure of the shell. Inner beams, rods and stiffened plates may also be employed for additional radial restraint.

21 Claims, 10 Drawing Figures

PRESSURE AND BUCKLING RESISTING UNDULATED POLYHEDRAL SHELL STRUCTURE

BACKGROUND OF THE INVENTION

This invention primarily relates to external pressure resisting shell structures, although its inherent structural rigidity can extend its usefulness to many other kinds of loadings such as internal pressure, gravity and wind loads, and concentrated forces. In the past, various geometrical shapes have been ued in the construction of such shell structures, including spheres, cylinders, toroids, paraboloids, ellipsoids, and combinations of these shapes. These shapes exhibit difficulties or disadvantages however. Because special forming operations such as machining, forging, spinning, rolling, casting, etc. are required to introduce the required curvature to these elements, these shapes are expensive to fabricate. Also, fabrication tolerances on such items as circularity or sphericity must necessarily be kept small in order to preserve buckling resistance and to minimize stresses occurring in the shell wall, again making these structures expensive to fabricate. Also, the inherent restriction of the above-mentioned techniques necessary for formation place a limitation on the size of the structural components from which a designer can select. The above-mentioned disadvantages limit the practicability of manufacturing large dimension (diameter, span, length) shell structures.

SUMMARY OF THE INVENTION

According to the teachings of this invention, a pressure resisting shell structure is formed by flat polyhedral plates arranged into a curved undulated cylindrical shell. The plates may be triangular or trapezoidal. In the case of triangular plates, the developable polyhedral surface is obviously composed of triangular faces, and has the following geometrical characteristics: (1) The bases of all the triangles are on mutually parallel planes — a line which is vertical to these planes is denoted as $x$. (2) The two triangular faces which own a side jointly make an identical angle to $x$. (3) The two triangles which own a base jointly have the identical orthogonal projection to a plane vertical to $x$. This orthogonal projection is also a triangle with the same base. The height of it is denoted as the amplitude $\alpha$; $\alpha$ characterizes the depth of the undulated polyhedral surface and is constant throughout the whole surface. (4) The $x$-coordinate of the base jointly owned by two triangles is in-between the $x$-coordinates of the vertices facing the base. (5) The macroscopical configuration composed by this surface is cylindrical, thus the quasi-curvature of the surface is approximately given by $$K(s) = 2\alpha/\lambda_s(s)^2$$

where $K$ = curvature, $s$ = circumferential coordinate, $\alpha$ = the radial amplitude of the polyhedral surface, and $\lambda_s$ = the half wave-length of buckle in the circumferential direction. In the case of trapezoidal plates, the quasi-curvature of the surface is approximately given by $$K(s) = 2\alpha/[\lambda_s(s)^2 - \lambda^s(s)^2]$$

where $\lambda_s$, $\lambda^s$ = bisections of the upper and lower bases respectively, of the trapezoids. The mathematical analysis and geometrical characteristics of the developable concave polyhedral surface are described in more detail in "Proposition of Pseudo-Cylindrical Concave Polyhedral Shells"by Koryo Miura, Institute of Space and Aeronautical Science, University of Tokyo, Report No. 442, November, 1969, which report is hereby incorporated by reference in the present disclosure.

The undulated polyhedral geometry exhibits a larger circumferential bending rigidity (and thus a greater resistance to buckling failure) than a perfect cylinder of equivalent overall dimensions, and requires no special forming operations to introduce curvature to the structural elements thus decreasing expenses and limitations placed on the size of structural components. Thus with this invention, large dimension cylindrical structures are more practical to manufacture.

While the polyhedral cylinder has a large circumferential bending rigidity, it is much less rigid in the axial direction. Thus, a means for providing additional axial stiffness, such as an inner cylinder, is provided and means, such as an end enclosure, are employed to deliver axial thrust (such as is produced by hydrostatic pressure) to the inner cylinder. An end structure for the inner cylinder is also provided. Also, internal members may be provided to provide further structural restraint of the polyhedral cylinder in the radial direction. These internal members may be used as bulkheads or for mounting floor sections.

There are many practical applications for the instant invention. For instance, the shell may be used for undersea petroleum storage with undersea petroleum extraction facilities. The inner cylinder could house the wellhead in a habitable environment for operating personnel and the space between the inner and polyhedral cylinders used for the storage and petroleum. The polyhedral plates may be formed from a transparent material and the structure used as an undersea observatory. Other modifications could faciltate the utilization of the shell as a spar buoy, as a submarine petroleum tanker, as a submarine underwater base, as an orbiting space station, as a land-based liquid storage vessel, and as an undersea nuclear reactor housing.

OBJECTS OF THE INVENTION

An object of the invention is to provide a pressure resisting cylindrical shell structure that is relatively inexpensive to fabricate, and, for the case of external pressure, that exhibits a greater resistance to buckling failure than similar prior art structures.

It is a further object of this invention to provide a pressure resisting cylindrical shell structure which can be manufactured with large span dimensions, such as the external diameter and length.

It is a further object of the invention to provide a pressure resisting shell structure that has a myriad of practical applications.

Other objects of the invention will become clear from an inspection of the detailed description of the invention.

DETAILED DESCRIPTION OF THE INVENTION

Figure 1:
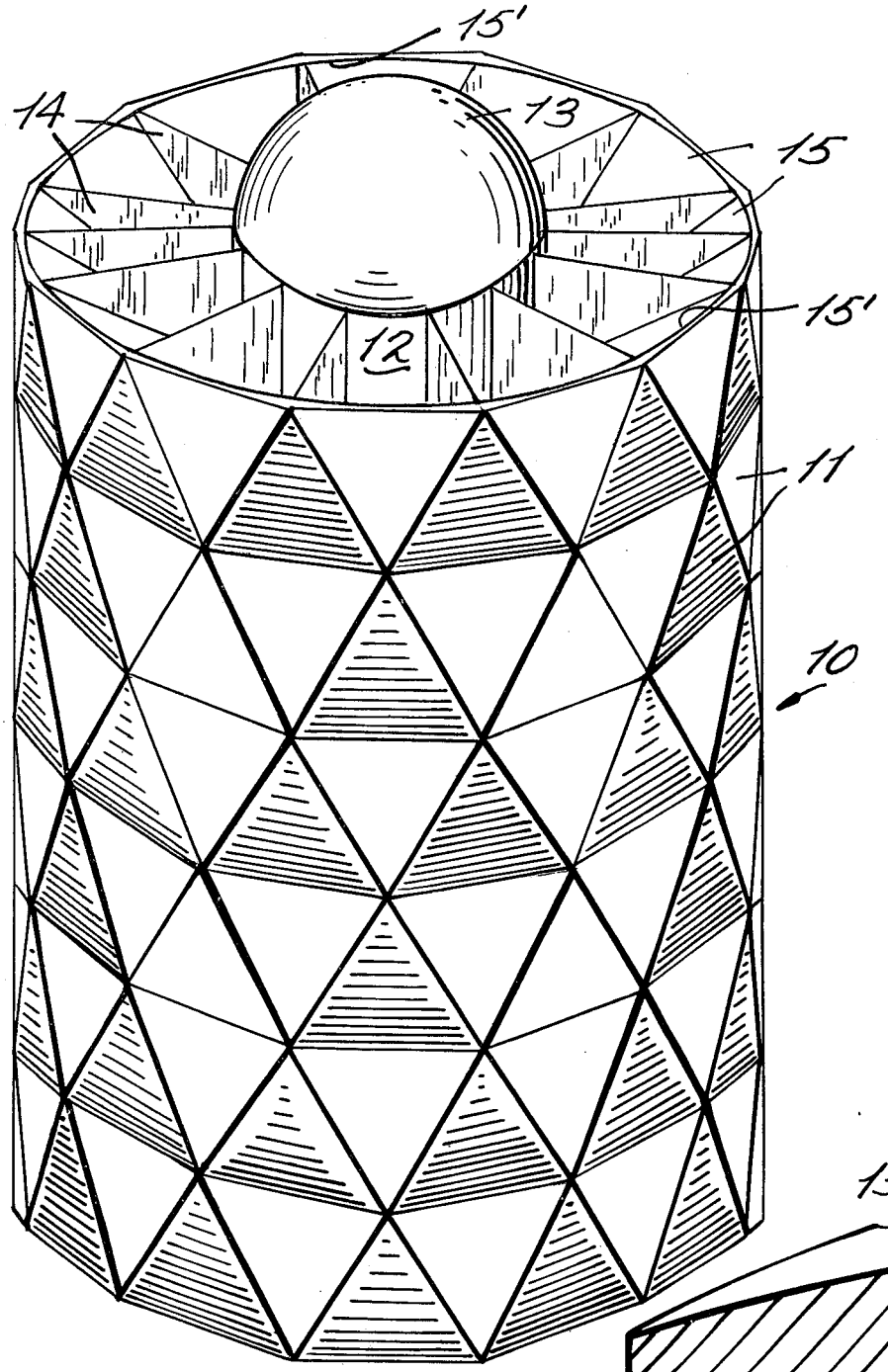
FIG. 1 is a perspective view of a shell structure according to the invention.
Figure 4D:
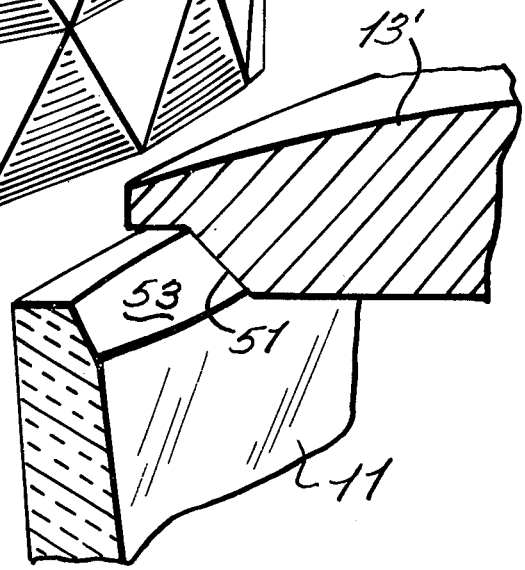
FIGS. 4 through 7 are diagrammatic view of various specific applications of the shell structure of the invention.

The pressure resisting shell structure according to the invention is generally depicted at 10 in the drawings. The external shell is formed with flat triangular or trapezoidal plates 11 sealed together along their edges to form a cylindrical structure, either circular or generally curved in cross-section in a macroscopic sense, with an undulated surface. Sealing can be accomplished by any suitable fluid tight sealing method including but not limmited to welding, heat sealing, and gluing. As mentioned above, this undulated polyhedral geometry has a larger circumferential bending rigidity than a perfect cylinder of equivalent overall dimensions. This property, in conjunction with an axially restraining structure contributes a greater resistance to buckling failure for the case of external pressure. Most structural materials can be used in the manufacture of this invention including most metals, many of the plastics, concrete with appropriate reinforcing, surface strengthened glass, ceramics, and wood.

Figure 2:
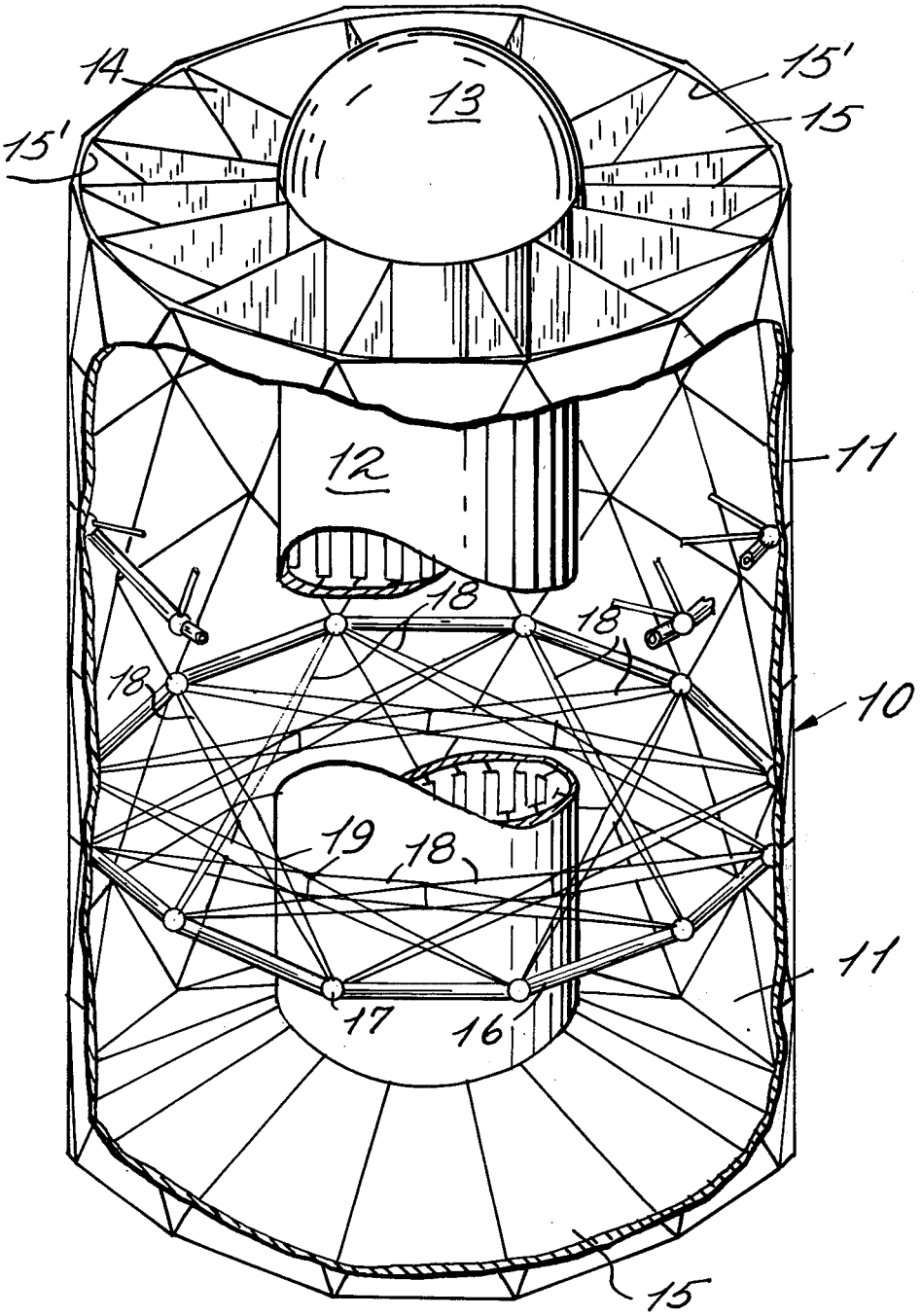
FIG. 2 is a view similar to FIG. 1 with part of the exterior shell and the inner cylinder cut away for clarity.

An internal cylindrical shell 12 with a smaller diameter than the polyhedral shell is disposed coaxially within the latter. This structure provides required additional stiffness in the axial direction, and in many applications can also serve as an area suitable for manned habitation, and as a secondary pressure vessel in case of failure of the primary polyhedral cylinder. End enclosure 15 is manufactured from truncated conical shell sections in a sealed water-tight engagement with internal cylinder 12 along its own adjacent edges and with the adapter ring 15'. The adapter ring 15' allows the curved edge of the conical section to adapt to the straight edge of plate 11. The adapter ring 15' may comprise any suitable structure for providing a circular inner edge to match the circular outer edge of member 15 (see FIG. 1), and an outer edge with straight sections to match the straight edges of plates 11. The adapter ring 15' is secured to the members 15 and plates 11 by any suitable conventional means providing a sealed connection therebetween. The arrangement of conical shell sections 15, as shown in FIGS. 1 and 2, forms an inverted frustum of a conical shell — this configuration assures that tensile membrane stresses predominate in the conical shell, thus assuring that the conical shell will not be sensitive to manufacturing inaccuricies and will not fail due to elastic buckling. Triangular structures 14 of stiffened plate or truss manufacture, each have one edge connected to internal cylinder 12, and their diagonal edge connection to the junction between two conical shell sections 15. Together with conical shell sections 15, triangular structures 14 help to deliver the axial load placed on the external shell to the inner cylinder. An end structure, such as hemispherical dome 13, is provided at each end of inner cylinder 12.

FIG. 2 illustrates an embodiment where rods and beams are employed to provide additional radial support, and thus still greater buckling resistance, for the external shell 11. Additional radial support means are optional. Other forms of additional radial restraint could also be utilized. The basic strength for the illustrated additional radial support means is provided by a set of spokes composed of tensile rods 18 which form a set of superimposed triangles, and by compression beams 16. As rods 18 are put in tension by radial deformation of the external shell, this tension is absorbed by the compression beams 16. Since beam 16 must carry a compression load, its moment of inertia must be large enough to prevent its own buckling and is generally much larger than that required for the tensile rods 18. To provide transverse buckling stability as well as transverse load carrying ability (so that the rods and beams can be used to mount a floor or bulkhead between the inner and outer cylinders), two tensile rods 18 ae used as each spoke member, and they are held apart by small compression members 19. Note that the geometry as is shown in FIG. 2 leaves a central opening through which the inner cylinder 12 can pass without any form of attachment to the bulkhead 16–19. In this way, no additional loads are imposed on inner cylinder 12.

Figure 3:
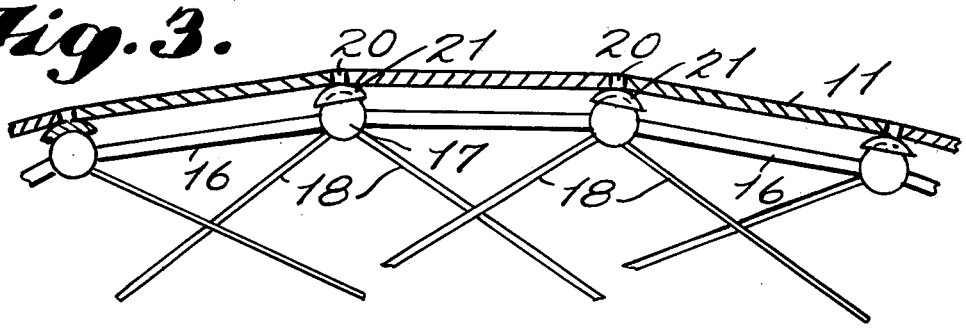
FIG. 3 is a partial cross-sectional view illustrating the details of a lightweight structural arrangement which adds rigidity to the polyhedral cylinder in the radial direction.
Figure 4A:
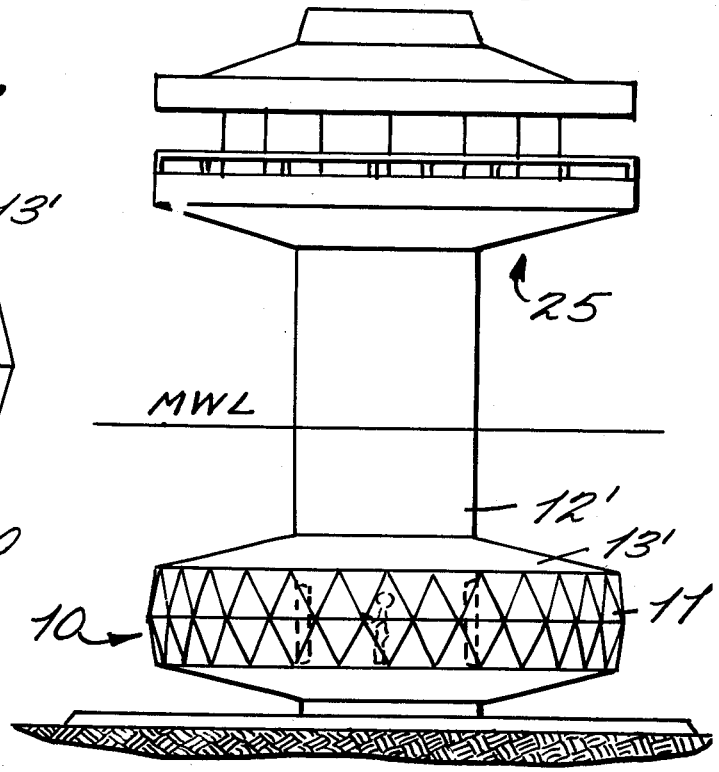
Figure 4C:
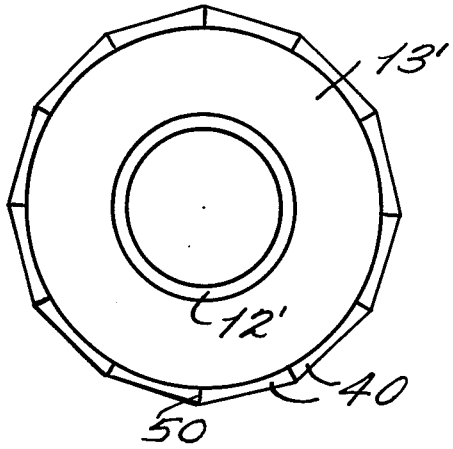
Figure 4B:
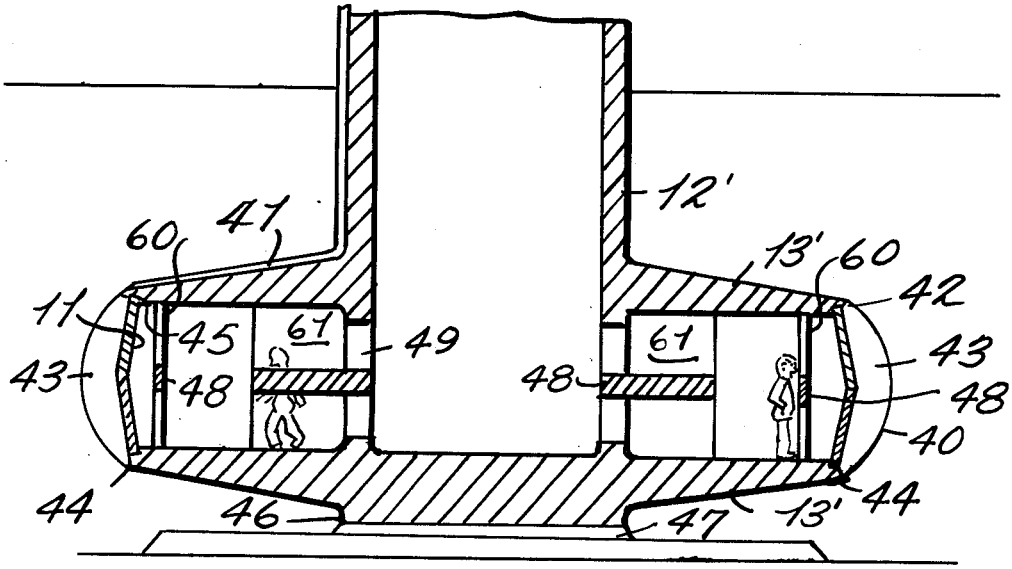

FIG. 3 illustrates a manner of attaching the internal beams and rods to the external plates 11. The beams 16 and rods 18 are joined by spherical joints 17, (the rods 18 and beams 16 each emanating in joints 17, as clearly shown in FIG. 3) which in turn are retained by spherical cups 21 having a cylindrical foot 20 which is inserted into a hole in the external shell wall in a water-tight engagement. Cylindrical feet 20 can be used at each junction in the external shell if the elements 11 are welded together. By boring a hol at the junctions of elements 11 and inserting a cylindrical foot, obtention of a perfect weld at the junction is facilitated.

Since no special size limiting, error-sensitive, and costly mechanical deformation operations such as forging, spinning, rolling, etc. are required for the formation of the shell of the present invention, and since the individual elements 11 can be symmetrical and are easily mass produced costs are reduced and due to a greater resistance to buckling, larger dimensioned structures can be constructed with less sensitivity to manufacturing inaccuracies.

Various specific applications of the structure according to the invention are depicted in FIGS. 4 through 7. FIG. 4(*a*) shows an undersea observatory. Elements 11 can be made of a transparent material to provide an unobstructed 360° viewing area. Since the elements 11 are flat, there is minimal optical distortion. Element 12', in addition to functioning as a secondary pressure vessel and providing necessary axial restraint, also serves as a means of ingress and egress to an above surface structure such as observation deck 25, or a bridge or boat dock. The end structure 13' could be a frustum of a cone either formed as an integral part of 12' (especially where 12' was formed of reinforced concrete), or attached thereto. Restraint in the axial direction can also be provided by structural columns 60 and walls 61 aligned axially between each end structure 13'.

FIGS. 4(*b*) and 4(*c*) are sectional views disclosing further details of the undersea observatory depicted in FIG. 4(*a*). End structure 13' and internal cylinder 12' can be integrally formed of reinforced concrete. End structure 13' is sealably connected to plates 11, for example, by an epoxy or elastomer seal at 45. Example of such a connection is given in FIG. 4(*d*). A flanged retaning edge 51 is molded in the concrete end structure 13' to provide positive restraint of plates 11. The edges of plates 11 are formed with a conical surface 53 so as to conform to and closely fit the retaining edge 51. The base 46 of the observatory rests on a foundation 47 made of a material such as grouted gravel or concrete.

Diametrically opposed doorways 49 disposed in 12' provide access from the interior of 12' to the viewing area adjacent transparent plates 11. In the case where the differences in the coefficients of thermal expansion of the axially restraining structures 12', 60 and 61 and plates 11 are great and large temperature variations are to be encountered, a material 48, such as a plastic with a higher coefficient of thermal expansion than 11, can be provided within 12', 60 and 61 to compensate for any thermally induced stresses occurring between plates 11 and end enclosure 13'. 40 is a protective transparent shield which could have its external surface coated with a transparent material to prevent biological fouling, which may impair visibility, such as methyl methacrylate impregnated with tributyltin. This shield can be assembled from developable elliptic cylindrical segments 40, as shown in FIGS. 4(*b*) and 4(*c*), or from doubly curved elliptic toroidal shell sections. Joints 50 (shown in FIG. 4(*c*)) may sealably connect the segments 40. Fresh water or chemically treated fluid 43 can be disposed between plates 11 and protective shield 40 to prevent any material degradation of plates 11. Supply tube 41 brings the fluid 43 to sprinkler tube 42, which admits the fluid to the volume between 11 and 40. Outlets or one-way valves 44 allow purging of the volume of fluid between 11 and 40.

Figure 5:
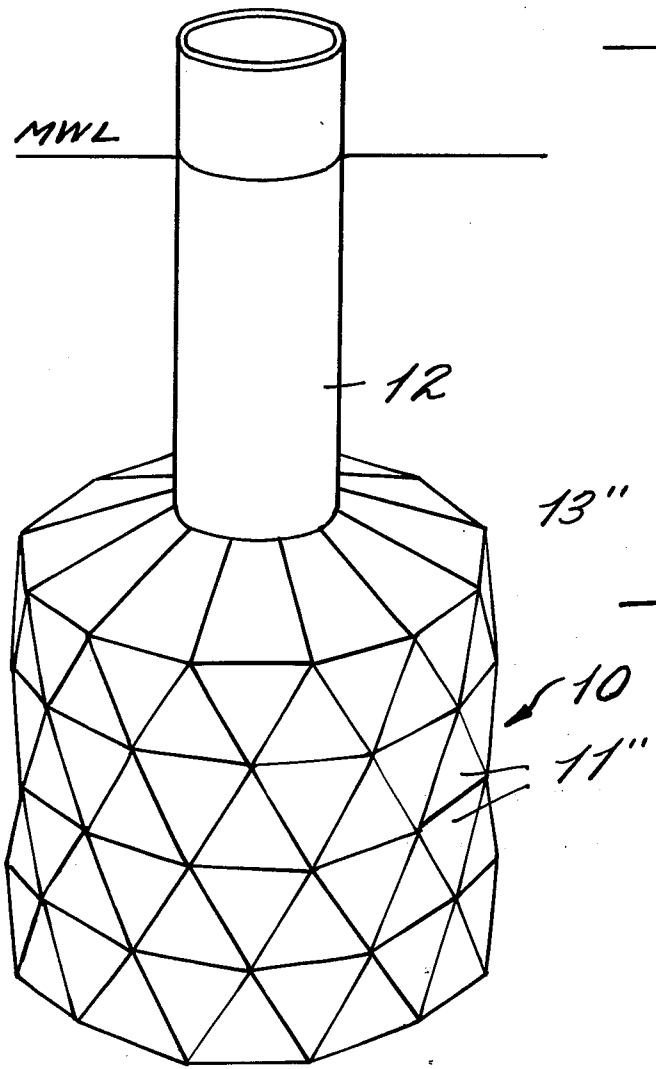

FIG. 5 shows a spar buoy. The structure 10 provides buoyancy and a storage volume for liquids. 13" provides the end closure, while 12" provides axial restraint, transmits the buoyancy load through the air-sea interface, and provides a means of access.

Figure 6:
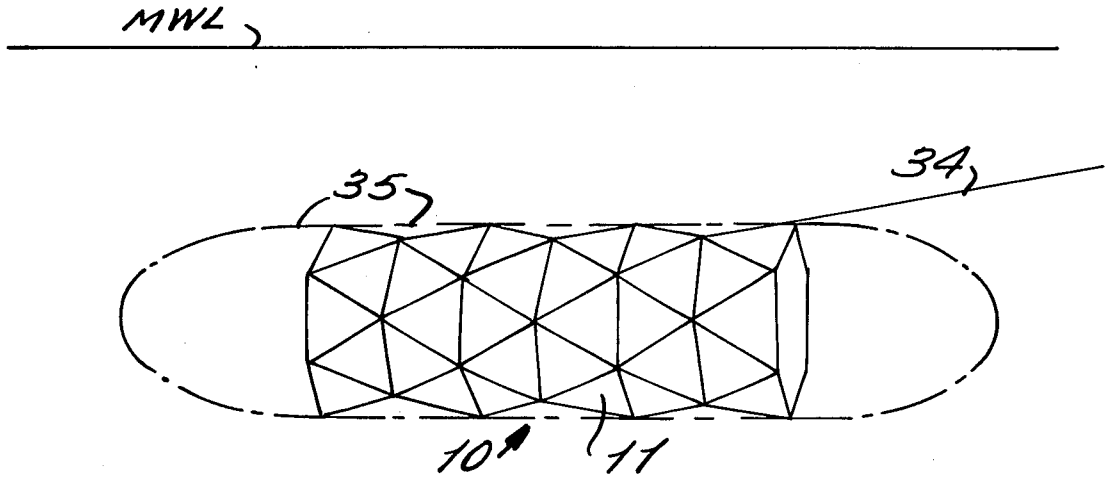

FIG. 6 shows the shell structure used for a submarine petroleum tanker. Element 35 is attached to each of the vertices of triangles 11 thereby restricting axial deformation as well as providing hydrodynamic fairing to reduce drag forces. A tow line 34 may be connected to a surface ship pulling the submarine tanker.

Figure 7:
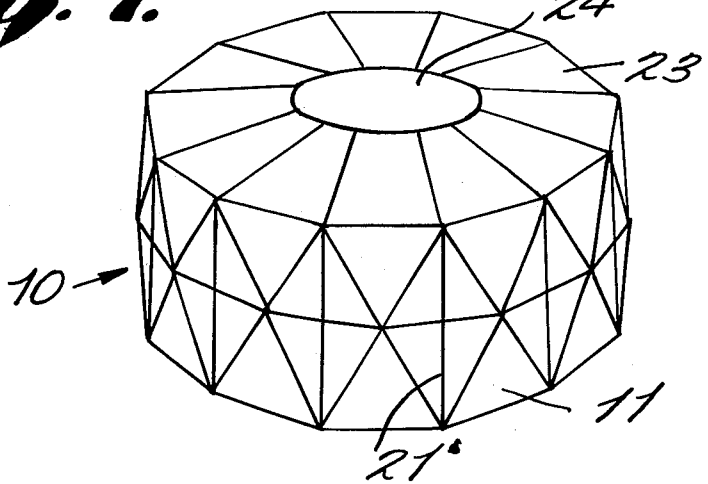

FIG. 7 shows the polyhedral shell of the invention used as an integrally pressurized structure. Tension elements 21' are small diameter rods attached between the vertices of elements 11, and provide the necessary axial restraint. Elements 23 can provide the end structure, while element 24 represents a hatch. This structure could be used as an orbiting space station or liquid storage vessel.

According to the teachings of the present invention an undulated polyhedral cylinder, as depicted in FIGS. 1 and 2, can also be utilized as a submerged or semisubmerged housing for a nuclear reactor plant. Normally, the polyhedral cylinder 10 would resist external hydrostatic pressure; however, in the event of an internal overpressure or explosion this structure could be designed to expand its volume, thereby acting as a shock absorber and contain the radioactive debris. By designing the polyhedral cylinder to have a large amplitude undulating surface, the cylinder 10 would have the capacity to expand its volume much like a bellows through an axial extensional process whereby plastic hinges (localized material yielding) would be developed along the edges of plates 11 as adjacent plates rotate relative to one another. While the inner cylinder 12 would prevent axial contraction, a cut bisecting the inner cylinder would allow it to freely elongate.

It is apparent that the structure according to the invention can be used in many other applications, and that many other modifications of the basic structure are possible. For instance, double-curved shells as well as external cones may be used for the end structure, stiffened plate structures could be used as the floor or as bulkheads, base supports or legs could be added to the structure, viewports or hatches could be added where needed, and the triangular or trapezoidal elements could be stiffened with straight beams to further increase their load carrying ability. Other modifications are also possible, thus it is recognized that departure may be made from the preferred embodiments disclosed within the scope of the invention, which is to be accorded the full scope of the claims so as to embrace any and all equivalent structures and devices.

What I claim is:

1. A pressure and buckling resisting shell structure comprising a. a plurality of flat polyhedral plates, b. means for sealing said plates together along their edges to form a cylindrical shell with an undulating surface, c. means for providing axial structural restraint and d. means for sealing each end of said shell structure.

2. A shell structure as recited in claim 1 further comprising means for providing radial restraint in addition to radial restraint inherently provided by said cylindrical shell with an undulating surface.

3. A shell structure as recited in claim 2 wherein said means for providing additional radial restraint include a plurality of rod means and a plurality of beam means, and attaching means for attaching a plurality of said rod means and said beam means to the interior of a junction of a plurality of said polyhedral plates, said rod and beam means terminating at and joined by said attaching means.

4. A shell structure as recited in claim 3 wherein said attaching means include a spherical joint affixed to both said plurality of rod means and said plurality of beam means at said junction, a spherical cup attached to said spherical joint, and a cylindrical foot sealably fixed in a hole at the junction of said plurality of said polyhedral plates and attached to said spherical cup.

5. A shell structure as recited in claim 1 wherein said cylindrical shell with undulating surface comprises an outer shell, and wherein said means for providing axial structural restraint includes a smaller diameter inner cylindrical shell disposed within said outer shell, and transfer means for transferring axial thrust from said outer shell to said inner cylindrical shell.

6. A shell structure as recited in claim 5 wherein said transfer means includes a plurality of fustoconical shell sections together forming an inverted fustoconical end section and an adapter ring arranged between end edges of said flat polyhedral plates and said inner cylindrical shell, said fustoconical shell sections sealed to said inner cylindrical shell, to said adapter ring, and to each other, and said adapter ring sealed to said end edges of said flat polyhedral plates.

7. A shell structure as recited in claim 6 wherein said means for sealing each end of said shell structure includes said transfer means and a hemispherical dome disposed on said inner cylindrical shell.

8. A shell structure as recited in claim 6 wherein said transfer means further includes a plurality of axially disposed triangularly shaped plate or truss structures each affixed to the inner cylindrical shell and a junction between two of said conical shell sections.

9. A shell structure as recited in claim 1 wherein said means for providing axial restraint include rods, beams, plates and curved shells attached between the vertices of said flat polyhedral plates.

10. A shell structure as recited in claim 1 wherein said means for sealing each end of the shell structure consists of a dome.

11. A shell structure as recited in claim 1 wherein said polyhedral plates are triangular in shape.

12. A shell structure as recited in claim 1 wherein said polyhedral plates are trapezoidal in shape.

13. An undersea observatory comprising a. a plurality of transparent flat polyhedral plates, b. means for sealing said plates together along their edges to form a cylindrical shell with an undulating surface, c. means for providing axial structural restraint, d. means for sealing each end of said shell structure, and e. means for providing access between said undersea observatory and the surface.

14. An undersea observatory as recited in claim 13 wherein said cylindrical shell with undulating surface comprises an outer shell, and wherein said means for providing axial restraint include an inner cylindrical shell, structural columns and walls axially disposed within said outer shell.

15. An undersea observatory as recited in claim 14 wherein said inner cylindrical shell also functions as said access providing means.

16. An undersea observatory as recited in claim 11 further comprising a transparent protective shield for enclosing said plurality of transparent flat polyhedral plates.

17. An undersea observatory as recited in claim 16 wherein said protective shield is assembled from developable elliptic cylindrical segments.

18. An undersea observatory as recited in claim 16 wherein protective fluid is disposed between said transparent shield and said plurality of transparent flat polyhedral plates.

19. An undersea observatory as recited in claim 16 wherein said transparent shield has the external surface thereof coated with a transparent biological fouling preventing material.

20. An undersea observatory as recited in claim 13 wherein said polyhedral plates are triangular in shape.

21. An undersea observatory as recited in claim 13 wherein said polyhedral plates are trapezoidal in shape.

* * * * *